US011131138B2

(12) United States Patent
Wei et al.

(10) Patent No.: US 11,131,138 B2
(45) Date of Patent: Sep. 28, 2021

(54) SECURED DELIVERY RECEIVING CONTAINERS

(71) Applicants: Dongchuan Wei, Pleasanton, CA (US); Luis A. Sanchez, Fremont, CA (US)

(72) Inventors: Dongchuan Wei, Pleasanton, CA (US); Luis A. Sanchez, Fremont, CA (US)

( * ) Notice: Subject to any disclaimer, the term of this patent is extended or adjusted under 35 U.S.C. 154(b) by 212 days.

(21) Appl. No.: 16/102,612

(22) Filed: Aug. 13, 2018

(65) Prior Publication Data

US 2019/0368259 A1 Dec. 5, 2019

Related U.S. Application Data

(60) Provisional application No. 62/678,103, filed on May 30, 2018.

(51) Int. Cl.

| | |
|---|---|
| ***E05G 1/08*** | (2006.01) |
| ***E05B 37/00*** | (2006.01) |
| ***A47G 29/12*** | (2006.01) |
| ***A47G 29/20*** | (2006.01) |
| ***A47C 11/00*** | (2006.01) |
| ***A47G 29/14*** | (2006.01) |

(52) U.S. Cl.

CPC ..... *E05G 1/08* (2013.01); *A47C 11/00* (2013.01); *A47G 29/12* (2013.01); *A47G 29/14* (2013.01); *A47G 29/20* (2013.01); *E05B 37/0031* (2013.01)

(58) Field of Classification Search

CPC ..... A47G 29/141; A47G 29/20; A47G 29/12; A47G 29/1201; A47G 29/1216; A47G 29/1218; A47G 29/14; A47G 29/16; A47G 2029/148; E05G 1/08; E05B 37/0031; B65D 25/04; B65D 25/06; B65D 55/14; A47C 7/628; A47C 11/00; A47C 11/005; A47C 13/00

USPC ..... 232/19, 24, 25, 38, 39, 44, 45; 220/529, 220/532, 533, 534, 544; 70/63; 297/118

See application file for complete search history.

(56) References Cited

U.S. PATENT DOCUMENTS

| | | | |
|---|---|---|---|
| 618,846 | A | 2/1899 | Crowder |
| 2,803,512 | A | 8/1957 | Band |
| 4,161,274 | A | 7/1979 | Bishop |
| 4,894,717 | A | 1/1990 | Komei |

(Continued)

OTHER PUBLICATIONS

Bensinger, Greg; "Amazon's New Secret Weapon: Delivery Lockers"; The Wall Street Journal; Aug. 7, 2012; 2 pages.

(Continued)

*Primary Examiner* — William L Miller

(74) *Attorney, Agent, or Firm* — Alford Law Group, Inc.; Vy H. Vu

(57) ABSTRACT

A delivery receiving container for receiving and securely storing packages, the delivery receiving container comprising multiple independently accessible and lockable compartments that can be customized to the size of the package received. Embodiments of the invention can comprise dividers that divide the space inside the container into compartments for the receipt and storage of multiple packages from multiple deliveries. Dividers can be moved as needed to accommodate different package size for efficient use of space. The adjustability of the dividers and the multiple independent access compartment lids allow the delivery receiving container to receive multiple independent deliveries from different delivery companies.

22 Claims, 12 Drawing Sheets

(56) References Cited

U.S. PATENT DOCUMENTS

| | | | | |
|---|---|---|---|---|
| 5,148,974 | A * | 9/1992 | Clapper | A47G 29/1209 232/17 |
| 5,267,688 | A | 12/1993 | Benefield | |
| 5,794,844 | A | 8/1998 | Jenkins | |
| 6,247,641 | B1 | 6/2001 | Noblet | |
| 6,257,436 | B1 * | 7/2001 | McGlauflin | B65D 25/06 206/223 |
| 6,323,782 | B1 * | 11/2001 | Stephens | G07C 9/27 340/10.31 |
| 6,895,241 | B2 | 5/2005 | Hara | |
| 8,246,124 | B2 | 8/2012 | Mackillop | |
| 9,052,992 | B2 | 6/2015 | Irwin | |
| 9,223,315 | B2 | 12/2015 | Irwin | |
| 9,453,758 | B2 | 9/2016 | Motoyama | |
| D789,649 | S | 6/2017 | Irwin | |
| D795,524 | S | 8/2017 | Irwin | |
| 10,039,401 | B1 * | 8/2018 | Romanucci | A47C 7/628 |
| 10,292,519 | B1 * | 5/2019 | Sutton | A47G 29/1209 |
| 10,624,484 | B1 * | 4/2020 | Mountford | A47B 57/583 |
| 10,638,848 | B1 * | 5/2020 | Wesley | E05B 49/00 |
| 10,653,262 | B1 * | 5/2020 | Isreal | A47G 29/22 |
| 2013/0264381 | A1 * | 10/2013 | Kim | A47G 29/122 232/24 |
| 2016/0066732 | A1 * | 3/2016 | Sarvestani | G07F 17/12 232/24 |
| 2017/0251856 | A1 * | 9/2017 | Schaible | A47G 29/141 |
| 2018/0070753 | A1 * | 3/2018 | Eveloff | G07C 9/00912 |
| 2018/0303265 | A1 * | 10/2018 | Hearne | A47G 29/22 |
| 2018/0310714 | A1 * | 11/2018 | Becker | A47C 11/00 |
| 2019/0000255 | A1 * | 1/2019 | Dehner | E05B 47/023 |
| 2019/0167025 | A1 * | 6/2019 | Cherry | A47G 29/16 |
| 2019/0239650 | A1 * | 8/2019 | Nelson | E05B 65/52 |
| 2019/0387910 | A1 * | 12/2019 | Stoich | G07C 9/37 |
| 2020/0107664 | A1 * | 4/2020 | Yang | A47G 29/30 |
| 2020/0121087 | A1 * | 4/2020 | Kilburn | A47C 11/00 |
| 2020/0121088 | A1 * | 4/2020 | Chasnis, II | A47C 7/628 |
| 2020/0163480 | A1 * | 5/2020 | Waisanen | E05C 17/085 |

OTHER PUBLICATIONS

Quirk, Mary Beth; "Amazon Hopes Delivery Lockers Will Fix That Whole 'My Package Never Arrived' Problem"; Consumerist; Aug. 7, 2012; 3 pages.

Wikipedia; "Amazon Locker"; Wikipedia Foundation , Inc.; Dec. 14, 2018; 4 pages.

"U.S. Postal Service Parcel Delivery Lockers"; United States Postal Service—Office of Insepector Gernal; May 6, 2013 ; 1 page.

"U.S. Postal Service Parcel Delivery Lockers—Management Advisory"; United States Postal Service—Office of Insepector Gernal; Report No. DR-MA-13-002; May 6, 2013 ; 21 pages.

* cited by examiner

SECURED DELIVERY RECEIVING CONTAINERS

CROSS REFERENCE TO RELATED APPLICATION

This non-provisional United States (U.S.) patent application claims the benefit claims the benefit of U.S. Provisional Patent Application No. 62/678,103 entitled DELIVERY RECEIVING CONTAINER filed on May 30, 2018 by inventors Dongchuan Wei et al.

FIELD

The embodiments generally relate to a container for receiving and temporarily storing delivered packages.

BACKGROUND

The exponential growth of on-line retail sales has resulted in many benefits for consumers. Thanks to the emergence of a vibrant on-line marketplace, consumers are getting a greater selection of goods at better prices. Unfortunately, as with any new enterprise, the advent of on-line retail has also led to a host of problems. Chief among them is delivery theft.

Approximately 25 million packages are stolen annually. Each year, the number of packages stolen increases. On-line retailers have responded with a variety of options to combat delivery theft. For example, shipping companies may request to leave your delivery in a safer location, such as behind a side gate or even in the trunk of your car, if you are not available to receive the package. However, these alternative delivery locations may not be ideal for everyone. Some people may not have their car parked outside their house or they may not have a side gate.

Other security measures, such as requiring a signature upon receipt, also may be infeasible. Requiring a person to directly receive and sign for the package necessitates an adult being at home during normal delivery hours which generally coincides with normal working hours. Thus, unless the consumer works odd hours or telecommutes, requiring proof of receipt is generally not convenient.

There exists an urgent need for a storage container for receiving deliveries that is secure and can accommodate a variety of package sizes. Furthermore, the delivery receiving container should be able to receive a plurality of packages associated with multiple deliveries while the recipient of the package is away from their house.

BRIEF SUMMARY OF THE INVENTION

The embodiments of the invention are summarized by the claims that follow below.

DETAILED DESCRIPTION OF THE INVENTION

Figure 1A:
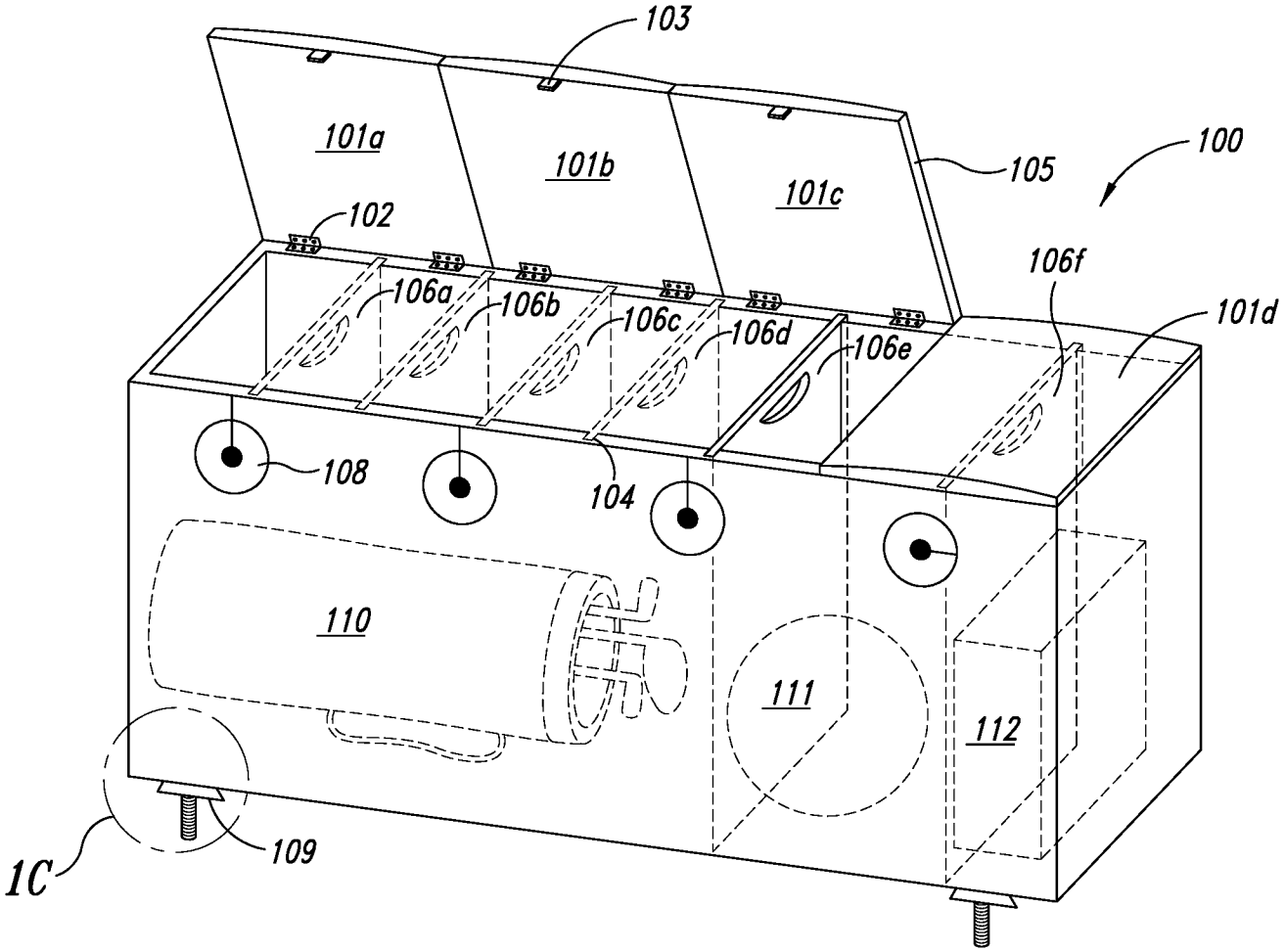
FIG. 1A is a perspective view of a delivery receiving container according to a first embodiment of the present disclosure.

In the following detailed description of the embodiments of the invention, numerous specific details are set forth in order to provide a thorough understanding of the embodiments of the invention. However, it will be obvious to one skilled in the art that the embodiments of the invention can be practiced without these specific details. In other instances well known methods, procedures, and components, have not been described in detail so as not to unnecessarily obscure aspects of the embodiments of the invention. No limitation of the scope of the disclosure is intended by these detailed descriptions.

Any alterations and further modifications to the apparatus and any further application of the principles of the present disclosure are fully contemplated as would normally occur to one skilled in the art to which the disclosure relates. In particular, it is fully contemplated that the features, components, and/or steps described with respect to one embodiment can be combined with the features, components, and/or steps described with respect to other embodiments of the present disclosure. The numerous iterations of these combinations will not be described separately. In addition, dimensions provided herein are for specific examples and it is contemplated that different sizes, dimensions, and/or ratios can be utilized to implement the concepts of the present disclosure. To avoid needless descriptive repetition, one or more components or actions described in accordance with one illustrative embodiment can be used or omitted as applicable from other illustrative embodiments. For simplicity, in some instances the same or related reference numbers are used throughout the drawings to refer to the same or like parts.

Introduction

On-line sales are the fastest growing category of retail. The exponential growth of on-line sales has led to an explosion of parcel post delivery. Where once package delivery required a signature confirmation, today packages are generally left at the door. Delivery companies simply do not have enough manpower to keep up with the high volume of deliveries they must perform. The ubiquitous one and two day deliver guarantee of some retailers has further exasperated the problem. Delivery companies are under a tight deadline to get orders to the consumer on time. To save time, delivery personnel will literally drop valuable packages at a front door to a dwelling and leave. Couriers do not have the time to wait for a signature from every recipient for all the packages they deliver.

Unsurprisingly, this unsecure practice of leaving unattended packages has led to an increase of theft of delivered goods. Millions of packages are stolen each year leading to hundreds of millions of dollars of loss that are passed onto the consumer.

The embodiments of the invention disclosed herein relate to a container for receiving and temporarily storing a parcel or package in a secured manner. The container generally can be a substantially rectangular box fully enclosed on five sides with one or more compartment lids in a top side coupled by hinges to a backside of the box. Other shapes for the delivery receiving container can also be utilized and are within the scope of the invention. The compartment lids are lockable and designed to provide access to the interior of the container. Preferably the compartment lids of the delivery receiving container are capable of being locked in a closed position without use of a key but require a key to unlock. The delivery receiving container can be bolted down to a surface with bolts to deter theft of the container and any contents. Inside the delivery receiving container are moveable dividers that partition the space inside the box into individual compartments. In certain embodiments of the invention, the delivery receiving container can function as an outdoor bench. In which case, the compartment lids can be padded or cushioned. Other embodiments of the delivery receiving container can also include a back support.

The delivery receiving container is preferably fabricated of a tamperproof material. Preferred materials include but are not limited to powder coated steel, aluminum, hard wood, hard plastic or composite resins. The preferred materials should be weather resistant. Thus, material chosen can be treated to be water and ultraviolet light resistant for outdoor use if not inherently weather resistant. Ideally, the preferred material should resist years of harsh weather conditions including extremes of temperature and humidity. The preferred material to construct the container should also be able to resist the attempts by opportunistic thieves to break into the container. Although within the scope of the invention, a fully secure container comparable to a safe would not likely be marketable. Thus, ideally, the delivery receiving container would be strong enough to resist attempts to break in with light tools such as a hammer, screwdriver, pliers, etc. yet still be easy to manufacture, transport, and install.

The delivery receiving container can be placed in front of a dwelling, thus it can be advantageous if the container is aesthetically pleasing as well as multifunctional. To that end, embodiments of the invention can double as a bench. Although not required, other ornamental features can be found on the container in order to enhance its aesthetic appeal. Molding, engraving, scrollwork, and the like can be added to the sides of the container. The container can be used in a visible and easily accessible location such as the front yard or front porch and thus having a pleasing façade is advantageous. Another benefit is that the delivery storage container looks like a bench, or other piece of furniture, and not a storage container. Accordingly, opportunistic thieves are more likely to pass by the delivery storage container.

The plurality of compartment lids that make up the top of the delivery receiving container are hinged on one edge to allow access to the inside of the container. Ideally, the hinges are mounted on the inside edge of the compartment lid and the inside edge of the container to prevent the hinges from being removed from the outside. The hinges can also be mounted on the outside of the container so long as they are secured via spot weld or tamper proof screws. Atop the compartment lids, a cushioning material can be affixed to make the compartment lid more comfortable as a seat. The cushion can also be treated to withstand the elements or be formed of a material that will resist water and ultra violet radiation.

Opposite the hinge, the compartment lid can also have a means of locking the compartment lid in a closed position. Each compartment lid can have a separate locking mechanism which can be opened with a key universal to each lock of that particular container. Each lock can be engaged when the compartment lid is placed in the closed position. The compartment lid can be locked without the use of the key so that all types of couriers can lock the container when they deliver their parcel. However, only the proprietor of the container can open the compartment lid with a key once the locking mechanism is engaged. Keypads and combination locks, can be used instead of a keyed locking mechanism and are also within the scope of the disclosure.

The multiple compartment lids allow access the inside the delivery receiving container. To further compartmentalize access, each container is divided into multiple spaces by dividers. In some embodiments of the invention, the dividers are fixed partitions that are equal in height and depth as the container. The divider can fit into slots formed in the inside walls of the container. Multiple dividers can be used to divide the space inside the container into smaller compartments, so that the space under each compartment lid can contain multiple compartments.

Dividers can be removed by pulling them up from the top. It would be advantageous to place dividers underneath their respective compartment lids such that the one or more divider under the compartment lid cannot be removed if the compartment lid is in the closed and locked position. Thus, even if an adjacent compartment lid is opened and unlocked, the divider under the locked compartment lid cannot be removed. This would prevent theft of a package by removal of adjacent dividers. A courier can thus place a package into the first available compartment, removing as many dividers as needed to hold the package. After placing the package into the compartment, the courier can lock as many compartment lids as necessary to cover over the package completely. Subsequent deliveries can be made at a later time by other couriers or the same courier to the container. By efficiently utilizing the interior space with movable dividers, the container can receive and securely store multiple packages by multiple deliveries.

In other embodiments of the invention, the dividers are slideable to adjust the size of each compartment. The dividers can be formed with tabs in their sides which fit into complimentary grooves in the sides if the container allowing the dividers to slide along the grooves. Of course, there should be a means of preventing access to locked compartments from adjacent open compartments, thus a means of locking or fixing the position of the sliding dividers would be preferred. Means for fixing the position of sliding dividers is discussed in more detail herein.

In other embodiments of the invention, a method of receiving multiple packages in multiple deliveries is disclosed. The method comprises, unlocking one or more compartment lids of a delivery receiving container; receiving a first package in the delivery receiving container by opening one or more compartment lids of the delivery receiving container, moving one or more dividers inside of the delivery receiving container to fit the size of the first package, closing the one or more compartment lids of the delivery receiving container above the first package; closing the one or more compartment lids of the delivery receiving container appropriate to cover the first package delivered, locking the one or more locking mechanisms related to the one or more closed compartment lids; receiving a second package in the delivery receiving container by opening one or more compartment lids of the delivery receiving container, moving one or more dividers inside of the delivery receiving container to fit the size of the second package, closing the one or more lids of the delivery receiving container above the second package; closing the one or more compartment lids of the delivery receiving container appropriate to cover the second package delivered, locking the one or more locking mechanisms related to the one or more closed compartment lids; unlocking the one or more locking mechanism related to the one or more closed compartment lids opening the one or more closed compartment lids; and retrieving the first and second packages in the delivery receiving container.

Methods of moving the dividers to adjust the size of the receiving compartment can include unlocking the divider from a first stationary position by lifting up the divider at a first pair of vertical slots, until tabs on the divider are aligned with horizontal guide grooves formed in opposing inner sidewalls of the delivery receiving container, sliding the divider along the guide grooves until the divider is at a second pair of vertical slots; and lowering the divider into the second pair of vertical slots until the bottom of the divider touches the bottom of the container at a second stationary position.

The dividers are configured so that they are the same height as the side walls of the delivery receiving container. While the tabs are aligned with the horizontal guide grooves, the top of the divider will be above the height of the side walls. Compartment lids cannot be closed while the dividers are in a movable position with tabs in the pair of horizontal guide grooves. Once the dividers are in the vertical slots and lowered to the bottom of the delivery receiving container, the compartment lids can be closed over the divider. Unless the compartment lid is opened, the divider cannot be lifted into alignment with the pair horizontal guide grooves thus preventing movement of the dividers.

In other embodiments of the invention, methods for moving the divider can include, unlocking the divider from a first stationary position by retracting retractable arms of the dividers from slots in one or more pairs of horizontal guide grooves formed in the inner side walls of the delivery receiving container, sliding the divider along the one or more pairs of horizontal guide grooves to a second stationary position, and extending the retractable arms into slots in the one or more pairs of horizontal guide grooves at the second stationary position.

Figure 1B:
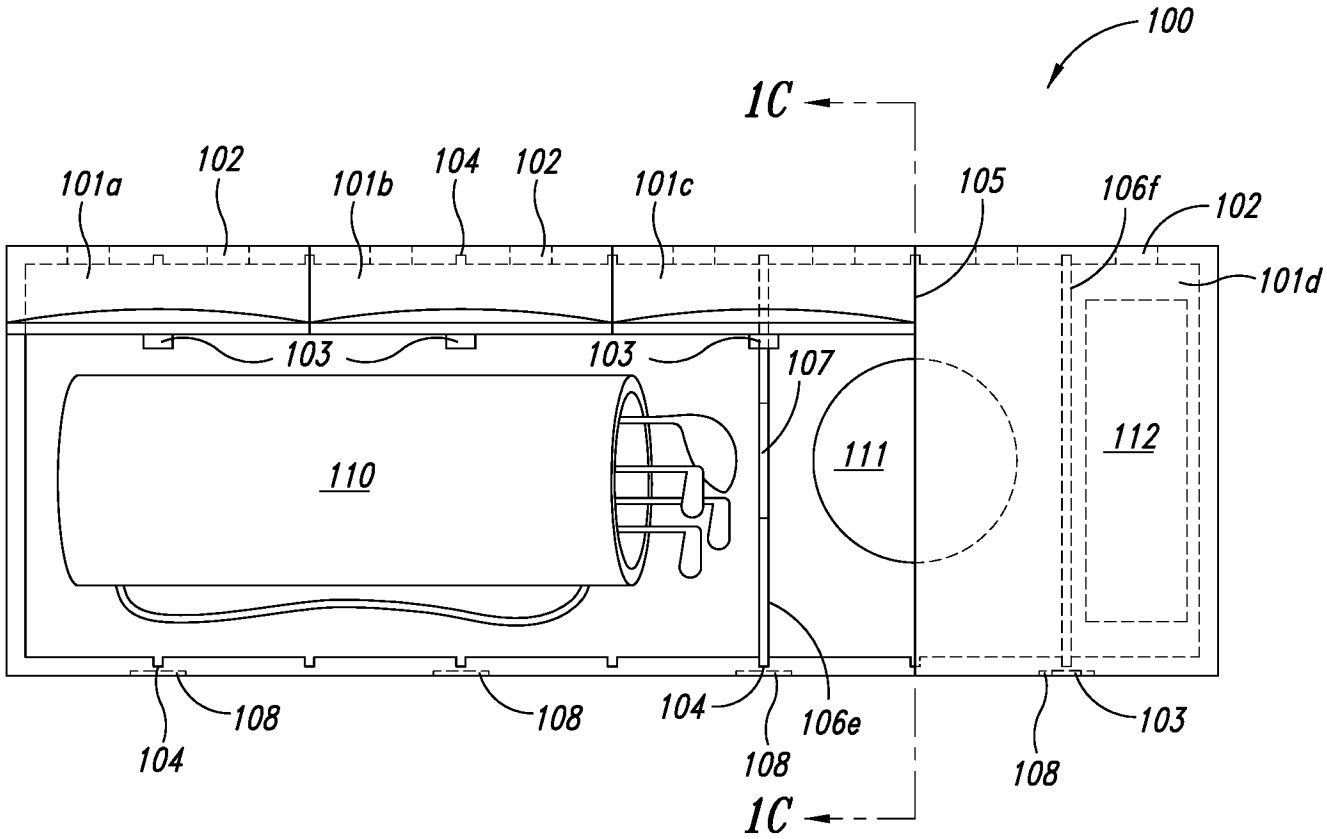
FIG. 1B is a top view of the delivery receiving container shown in FIG. 1A.
Figure 1D:
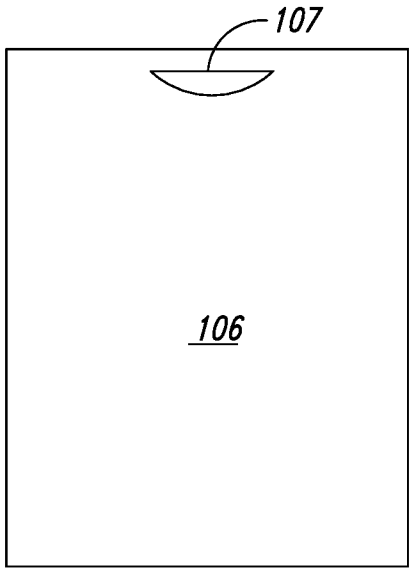
FIG. 1D illustrates an exemplary divider of the delivery receiving container shown in FIG. 1A.
Figure 1E:
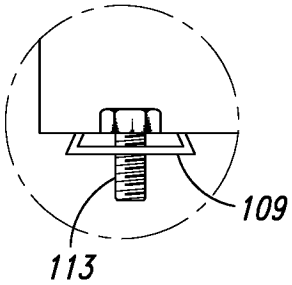
FIG. 1E is a magnified view of a portion of the delivery receiving container shown in FIG. 1A.
Figure 1C:
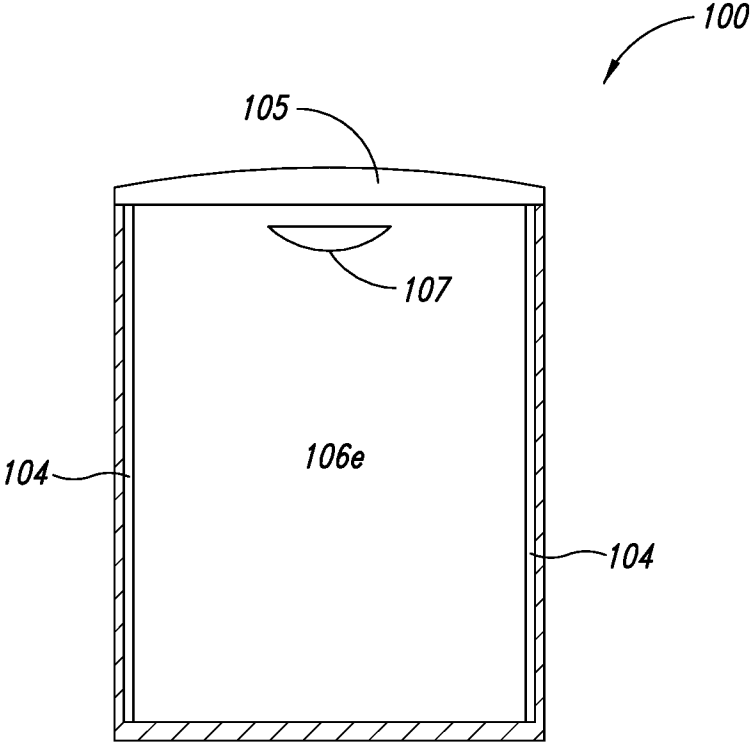
FIG. 1C is a cross sectional view of the delivery receiving container shown in FIG. 1A.

Referring now to FIGS. 1A-1C, a delivery receiving container 100 is shown in different views. The container 100 includes a plurality of compartment lids 101A-101D; hinges 102; latches 103; vertical slots 104; cushions 105; dividers 106A-106F; locking mechanisms 108; feet 109, and bolts 113. The delivery receiving container 100 can receive different sized packages or items such as a large item 110 (e.g., golf bag), a medium item 111 (e.g., water melon), or a small item 112 (e.g., small box).

On top of the container are multiple lockable compartment lids 101A-101D. The compartment lids 101A-101C are in the open position while compartment lid 101D is shown in the closed position. Each compartment lid 101A-101D can have a cushion attached to the top side, for example cushion 105. Each compartment lid 101A-101D can be locked by a locking mechanism 108A-108D. Locking mechanisms 108A-D couple to latch 103 to secure the compartment lid in a closed position. To prepare the container 100 for receiving a package, the owner of the container 100 can use a key, keyed specifically to each container 100, to place locking mechanism 108A-108D into an unlocked state. In the unlocked state, the compartment lid 101A-101F can be opened and closed freely.

When a courier needs to deliver a package, the courier can lift one or more of the compartment lids, compartment lid 101A for example, place the package in the compartment, close the compartment lid and switch locking mechanism 108A to the closed state. Locking mechanism 108A-D can be placed in the closed state (e.g. by turning a thumbturn, a switch, or sliding a latch) without the use of a key. However, preferably, locking mechanism 108A-108D cannot be unlocked (placed in the open state) unless a key is used. Effectively, the locking mechanism 108A-108D allows the courier of any company to deliver a package to the delivery receiving container without needing a key. Thus, the delivery receiving container is universally useable by all delivery companies. Once locked up, the package is secure until the owner returns home to unlock locking mechanism 108A-108D and retrieve the package from the delivery storage container.

Inside the container 100 are compartments for receiving and storing delivered packages. The compartments can be divided by multiple dividers 106A-106F. In some embodiments the dividers 106A-106F are horizontally stationary. The embodiment illustrated in FIG. 1A, have removable dividers that may be lifted out of their slots, thereby enlarging the size of the compartments. In other embodiments disclosed hereafter, the dividers 106A-106F may be slid horizontally to change the size and volume of the divided compartments.

Referring now to FIG. 1D, an instance of an exemplary divider 106 representative of each divider 106A-106F is shown. Each divider 106 includes a lift handle 107 located in the upper part of the body of the divider. As shown in FIG. 1B, the dividers 106A-106F can be inserted and removed from vertical slots 104 along predetermined lengths within the container 100 to partition the inside of the container into compartments. Vertical slots 104 can be routed into the inner wall of container 100. For more security, slots can be reinforced with corner beads. Each vertical slot 104 can be substantially equal in width to the width of the dividers 106A-106F to allow the dividers to securely slide into place without much play. The number of vertical slots 104 determine the adjustability of the size of the compartments. More vertical slots 104 allow dividers 106A-106F to be placed in more locations along the length of the container, thus increasing the variability in the compartment sizes.

Referring now to FIGS. 1C-1D, each of the dividers 106A-106F are preferably of substantially equal dimension to the height and depth of the inside of the container, such that once slotted into place, the dividers leave minimal gaps between the divider and the inner container walls. Minimal gaps make it harder for thieves to tamper with adjacent compartments. Dividers 106A-106F are substantially equal in height to the height of the inside of the delivery receiving container. The width of the dividers 106A-106F are equal to the depth of the inside of the container. Each divider is preferably made of a durable tamper proof material, such as steel or hard plastics, capable of resisting a thief attempting access to a locked compartment through an adjacent open compartment. The material of each divider can be 18-gauge steel with a thickness of 3-4 millimeters (mm) for example to be a sufficient deterrent against the average opportunistic thief. Material with similar durability can be substituted and is within the scope of the invention.

Dividers 106A-106F can be fitted into vertical slots 104 routed or otherwise formed in the inner walls of the container. Once fitted into the slot 104, the divider 106A-106F substantially extend to the edge of the height and depth of the container leaving minimal gap between the dividers 106A-106F and the top, bottom, and sides of the container. To remove a divider 106A-106F, lift handle 107 can be used to lift the divider 106A-106F out of their respective slot. Dividers 106A-106F can be replaced in their respective slots in a reverse fashion. It should be noted that in order to remove or replace a divider 106A-106F, a compartment lid 101A-101D above the slot holding the divider in question must be in the unlocked and open position. Securing the divider 106A-106F under a compartment lid 101A-101D can prevent a burglar from accessing a package through an adjacent compartment.

Dividers 106A-106F allow the space inside each container 100 to be used efficiently. By removing the appropriate number of dividers to just fit the package being delivered, multiple items can be received and stored in the same container 100. For example, large items such as golf clubs 110 can be placed into container 101 after the appropriate number of dividers are removed. In FIG. 1A, four dividers 106A-106D are shown removed to accommodate golf clubs 110. The removed dividers 106A-106D are illustrated with dashed lines as they are optionally placed in those positions within slots, and signify that they are removed to make room for the golf clubs 110.

Likewise, medium packages, such as watermelon 111, can be placed in another compartment where only one divider 106D needs to be removed to accommodate the medium sized package 111. In some embodiments of the invention, compartment(s) can be insulated to preserve items until the owner of the container 100 has the time to retrieve them. For example, the compartment between divider 106D and 106F can be insulated to maintain the temperature inside the compartment. Produce, such as watermelon 111 or other perishables can be placed within the container 100 inside the specially insulted compartments.

In FIG. 1A, small packages, such as a small box 112 can also be placed within the container 100 without removing any dividers 106. The small box 112 efficiently fits inside the compartment and allows for other packages to be placed concurrently inside the container 100.

Container 100 can be used outdoors to facilitate the swift and easy receipt of packages from delivery personnel. As such, container 100 is advantageously made of a weather resistant material to keep packages safe and dry from inclement weather. To keep container secure and dry feet 109 can be attached to the corners of the container. The feet 109 raise the container a few inches off the ground, thereby keeping the container out of any standing water or moisture. The feet 109 can also be bolted to the ground, preferably to a solid surface such as reinforced concrete. In certain embodiments, the feet 109 are secured to a solid surface by bolts 113 through the feet 109 of the container. The head of the bolts 113 are only accessible from the inside of the container 100, adding an additional layer of protection. The bolts 113, can prevent the entire container and its contents from being stolen. To remove the bolts 113, a thief would have to access the inside of the container and then spend valuable time backing out each bolt from a hard surface. Feet 109 can also be individually extended to allow for some stabilization on uneven ground.

Figure 2A:
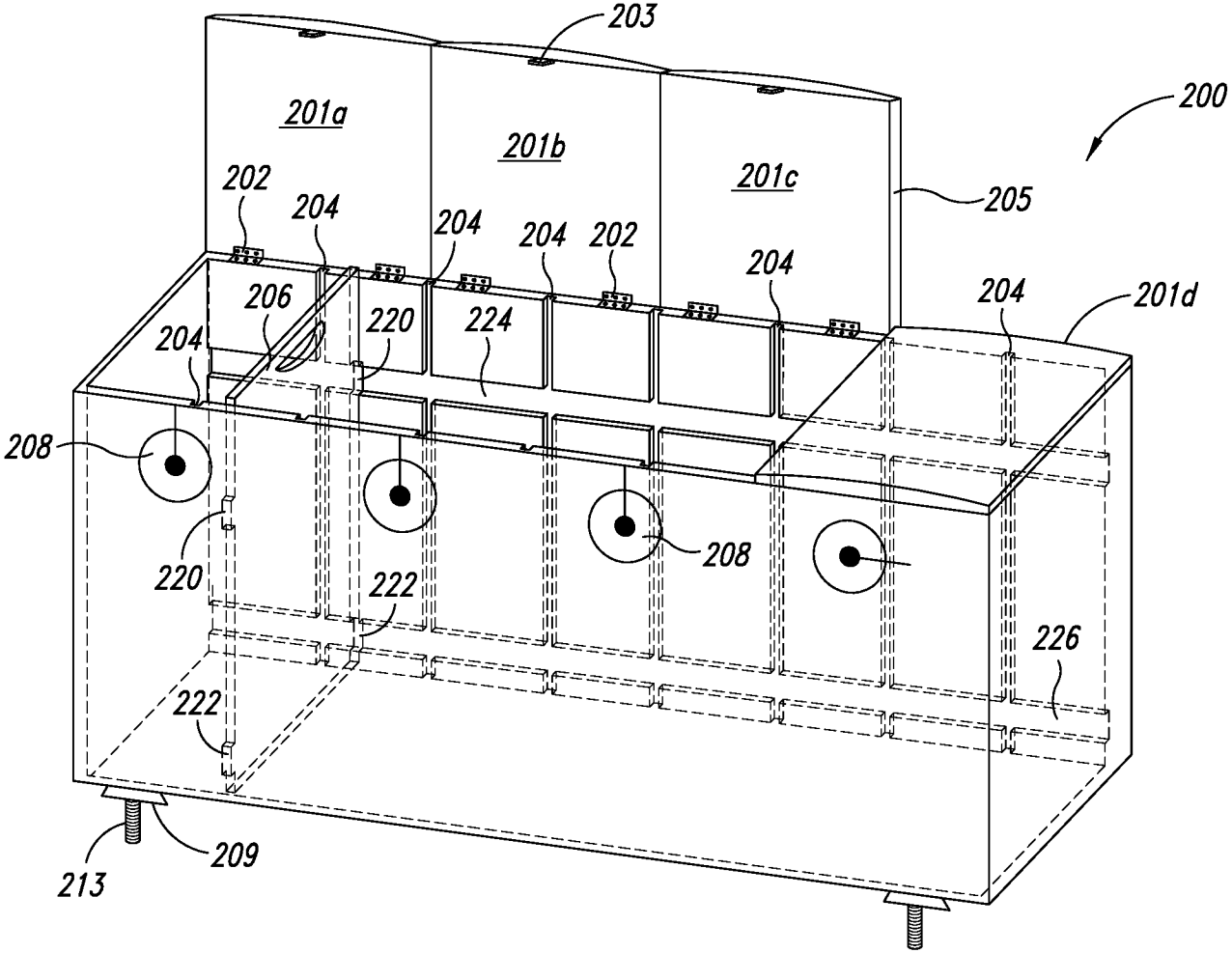
FIG. 2A is a perspective view of a delivery receiving container according to another embodiment of the present disclosure.
Figure 2B:
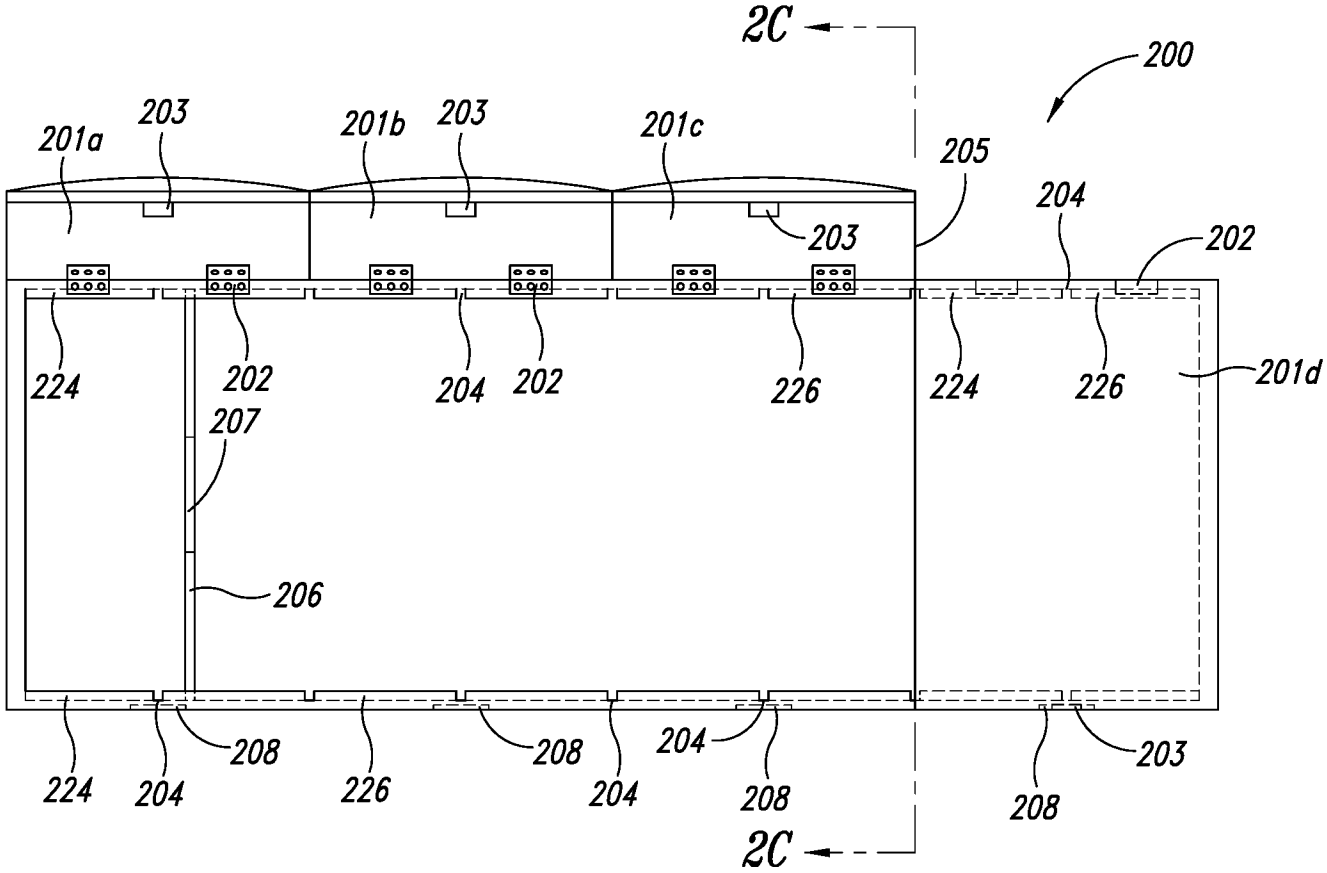
FIG. 2B is a top view of the delivery receiving container shown in FIG. 2A.
Figure 2D:
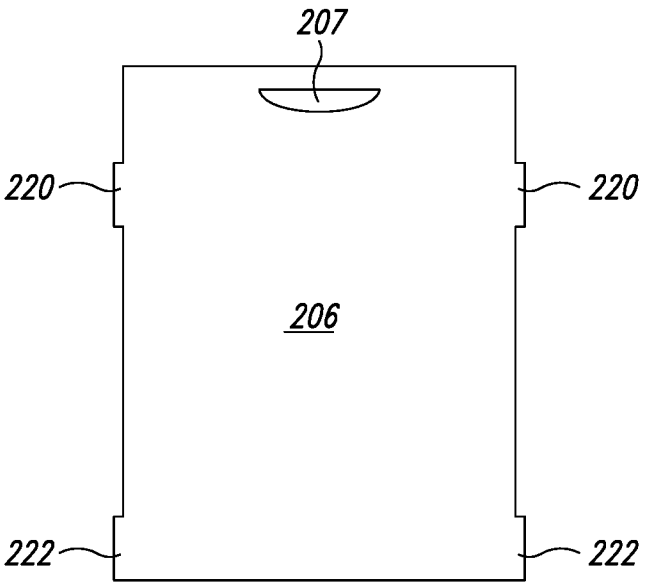
FIG. 2D illustrates an exemplary divider of the delivery receiving container shown in FIG. 2A.
Figure 2C:
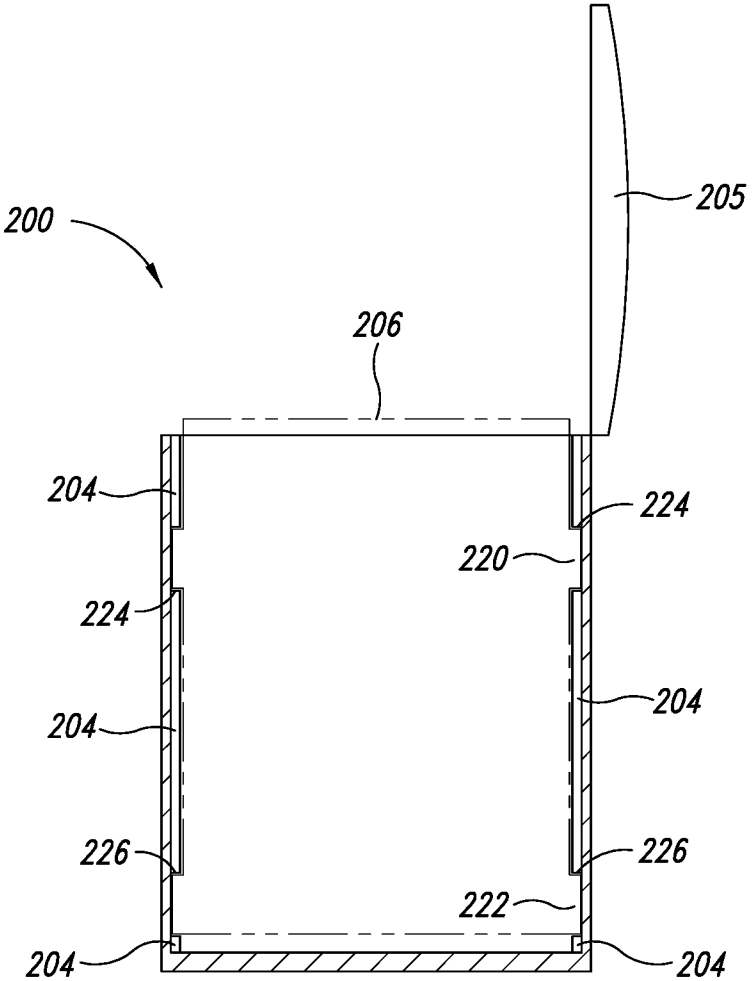
FIG. 2C is a cross sectional view of the delivery receiving container shown in FIG. 2A.

FIGS. 2A-2C illustrate views of a delivery receiving container 200. Container 200 can include compartment lids 201A-201D; hinges 202; latch 203; vertical slots 204; cushions 205; dividers 206; lift handle 207; locking mechanism 208; feet 209; and bolts 213. Container 200 shares many features of the container 100 illustrated in FIGS. 1A-1C. As such certain feature are relatedly numbered with identical last two digits for ease of reference. Certain features shared with previously described embodiments may not be discussed again for the sake of brevity.

Similar to container 100 shown in FIG. 1A, FIG. 2A illustrates delivery receiving container 200 that comprises storage compartments of variable size for receiving and storing packages. Shared features with previous embodiments function similarly unless noted otherwise. One difference in container 200 from container 100 is that different types of dividers are utilized.

Referring now to FIG. 2D, the dividers 206 have upper tabs 220 and lower tabs 222 along each side of the body of the divider 206. The tabs 220,222 are generally rectangular in shape and are unitary with the body of the divider. The tabs 220,222 of the dividers 206 are insert into guide groove 224,226 respectively on each inner side of the container 200 as can be seen in FIG. 2C. The complimentary tab and groove association allows the dividers 206 to slide along the length of the container 200 above its bottom surface. An advantage to the sliding divider 206 is the dividers 206 do not need to be lifted out of the container 200 to be repositioned and then possibly misplaced. Dividers 206 can be slid along the guide grooves 224,226 to form the compartment size best suited to the size of the delivered package.

To slide a divider along the guide groove, the divider 206 is lifted slightly at one of the vertical slots 204 to enter guide grooves 224,226 before it can be moved. Once moved to the desired location associated with a slot, the divider 206 can be lowered down into that vertical slot 204. Lifting the divider into and out of vertical slots 204, combined with the use of tabs 220,222 and grooves 224,226, allows easy customization of the size of the compartment. On the other hand, the dividers that are slotted into a vertical slot 204 underneath a locked compartment lid 201A-201D of the container 200, cannot be lifted up into a guide groove, and thus are deterred from moving.

FIG. 2B, illustrates a top view of FIG. 2B. In this illustration, the three leftmost compartment lids 201*a*-201*c* are shown in an open position with the rightmost compartment lid 201*d* closed. Details such as the placement of vertical slots 204 can be more easily seen in FIG. 2B. A single divider 206 is shown near the leftmost vertical slot 204. Divider 206, in this illustration is aligned with guide groove 224 and can be moved horizontally, changing the size of the compartments. It should be noted, that while in divider 206 is aligned with the pair of guide grooves 224, the compartment lid that is over the divider 206 cannot be closed.

FIG. 2C, illustrates a cross sectional view of the delivery receiving container shown in FIG. 2A. Pairs of guide grooves 224 can be seen on opposite sides of the side walls of container 200. Tabs 220/222 of divider 206 are configured to fit into and slide along guide groove 224. While tabs 220/222 of divider 206 are inserted into guide groove 224, the top of divider 206 can protrude above the top of container 200. This design prevents the compartment lids 205 from closing completely, thus reminding the delivery person to slide the divider 206 into vertical slot 204. Once in vertical slot 204, the divider can be pushed down so that the bottom of the divider touches the bottom of container 200 and the top of the divider 206 is just at the lip of the container 200. In this position the tabs 220/222 are misaligned from guide grooves 224, thus locking the divider 206 in a horizontally stationary position. Once compartment lid 205 is closed, the divider 206 will also be locked in a vertically stationary position.

Figure 3A:
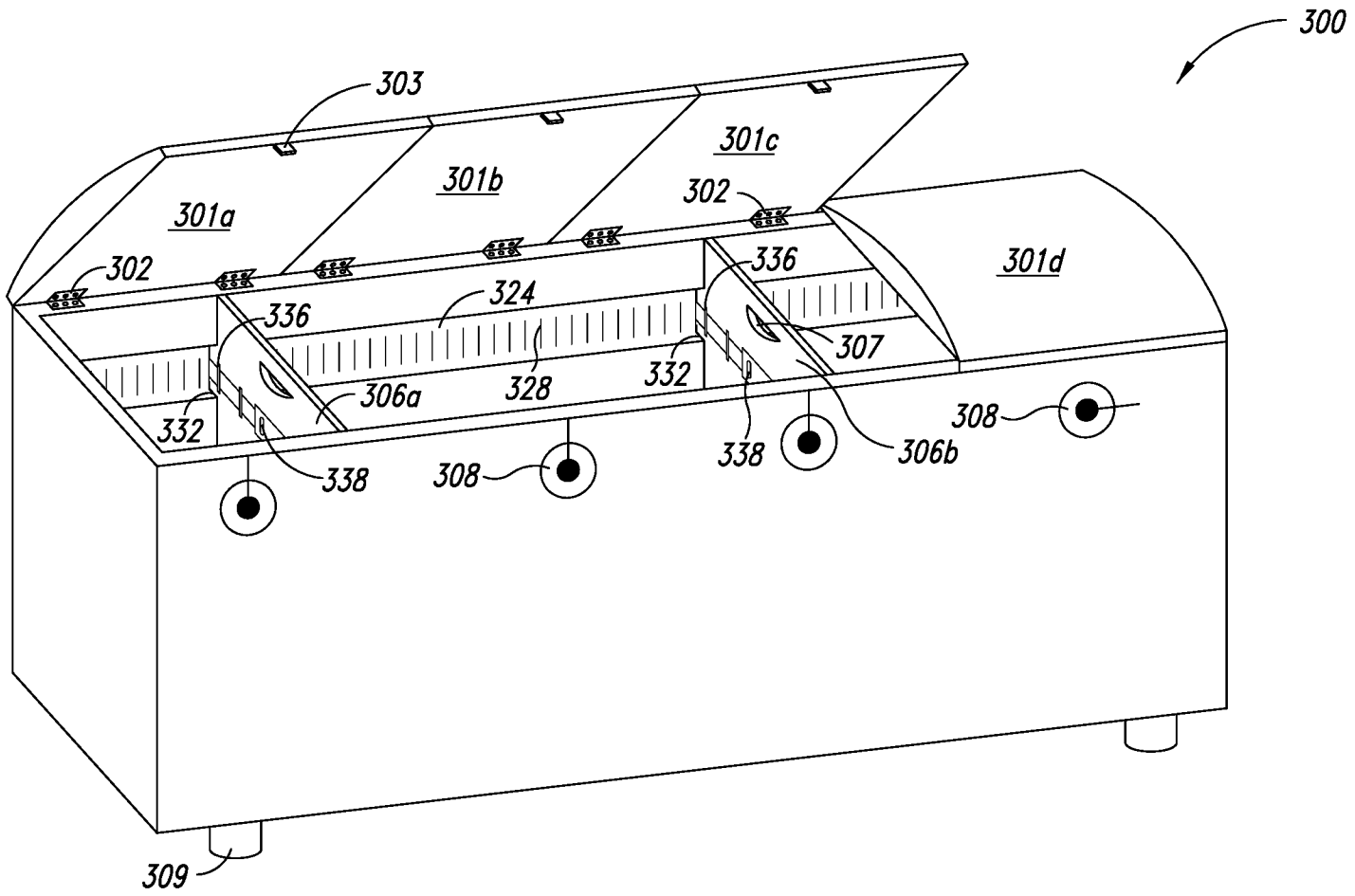
FIG. 3A is a perspective view of a delivery receiving container according to another embodiment of the present disclosure.
Figure 3B:
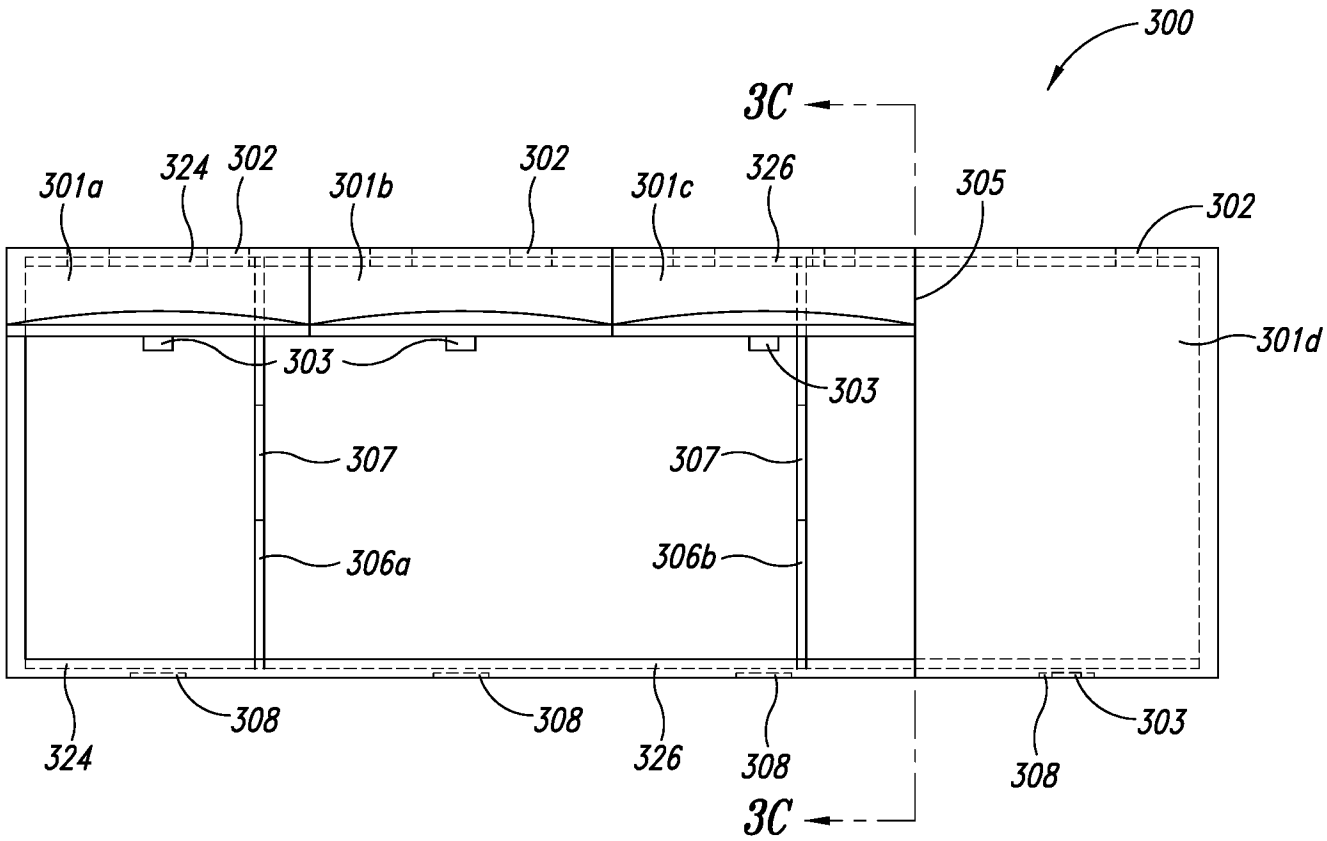
FIG. 3B is a top view of the delivery receiving container shown in FIG. 3A.
Figure 3D:
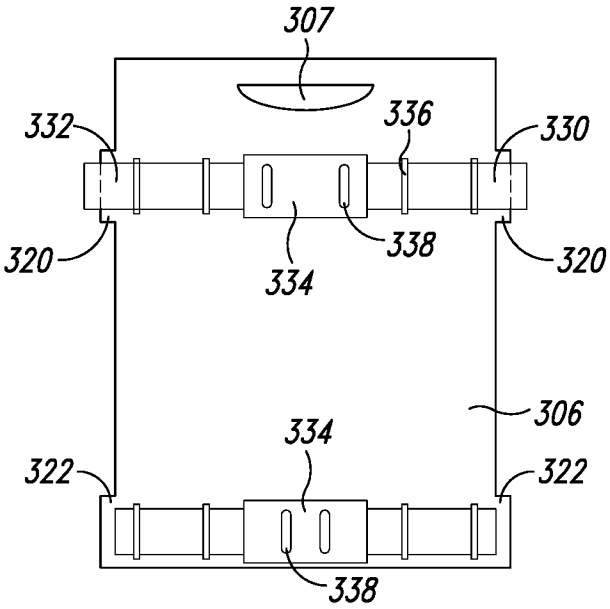
FIG. 3D illustrates an exemplary divider of the delivery receiving container shown in FIG. 3A.
Figure 3C:
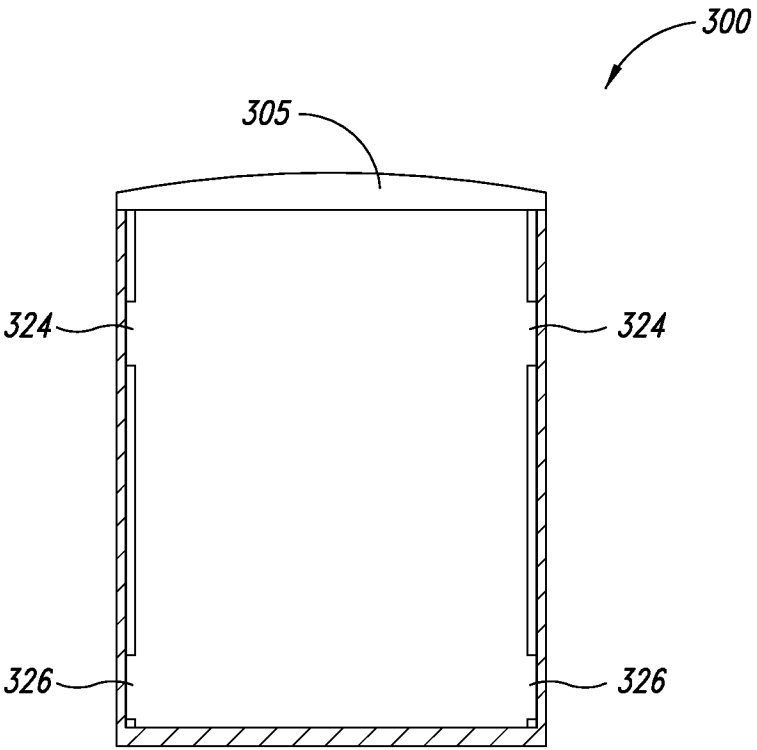
FIG. 3C is a cross sectional view of the delivery receiving container shown in FIG. 3A.

Referring now to FIGS. 3A-3C, a delivery receiving container 300 is shown. Container 300 includes moveable dividers with a locking mechanism. Container 300 can comprise lids 301A-301D; hinges 302; latch 303; cushions 305; dividers 306; lift handle 307; locking mechanism 308; feet 309; and bolt 313. The container 300 illustrated in FIGS. 3A-3C, shares many features of the containers 100,200 shown in FIGS. 1A-1C and 2A-2C. As such, certain features are relatedly numbered with identical last two digits for ease of reference.

In FIGS. 3A-3B, the container 300 is shown with the leftmost compartment lids 301A-301C in an open and upright position. Compartment lid 301D is shown in a closed position. Dividers 306A and 306B are illustrated as moved to a position underneath compartment lid 301A and 301C respectively. As best seen in FIGS. 3A and 3C, container 300 includes guide grooves 324 and 326 in front and back inner side walls. Each of the guide grooves 324,326 have slits 328 routed into the back of them as best seen in FIG. 3A. Each of the plurality of dividers 306A,306B (collectively referred to by reference number 306) are capable of being moved and locked in place at multiple positions, determined by the spacing of the slits 328 in the grooves, to create compartments of different sizes within the container 300.

Referring now to FIG. 3D, an exemplary divider 306 is shown for each instance of the dividers 306A-306B. Each divider 306 includes tabs 320,322 to respectively slide in the grooves 324,326 of the container 300. Each divider 306 further includes one or more divider securing mechanism 334 coupled to the main body of the divider. Each divider securing mechanism 334 can have retractable arms 330 and 332 extending out past the tabs 320,322 of the divider 306. The end of the retractable arms 330,332 are configured to fit into slits 328 in the guide grove 324,326 of the container 300. Each arm 330,332 can be secured to the divider 306 by brackets 336 for added durability and security. The retractable arms 330,332 can be spring loaded to bias the arms to extend slightly past the edges of the tabs 320,322 on the divider 306 and into the slit 328. The retractable arms 330,332 can be retracted by squeezing protrusions 338 of each arm together against the spring force, moving the ends of the arms 330,332 out of the slit 328. In this case, the ends of the retractable arms 330,332 withdraw from the slits 328 in the grooves of the container 300.

In FIG. 3D, the top divider securing mechanism 334 is illustrated in an extended position with the 330 and 332 extended out past tabs 320 and 322 respectively, to lock into complimentary slit 328 of FIG. 3A. The bottom divider securing mechanism 334 is illustrated in a retracted position. Protrustions 338 are squeezed together, retracting the arms inboard of tabs 322 and out of slits 328.

When a courier wishes to deliver a package to the container 300, the courier lifts the compartment lid 301A-301D and places the package inside the first available compartment. To save space, the courier can move the divider 306A or 306B by squeezing the arms 330 and 332 in towards each other, retracting arm 332 from slit 328 in the guide groove 324 (as well as retracting arm 330 from a slit opposite slit 328, not shown). Once the arms 330,332 are retracted, the divider 306 is free to move along the guide groove 324.

It is preferable to mount the divider securing mechanism on one side of the divider only. If mounted on the left side as illustrated in FIG. 3A, the preferred method of delivery would be to use the first available compartments from left to right. By doing so, access to the divider securing mechanism 334 can only be achieved from an unlocked compartment lid 301 above the divider 306A. Therefore, locking the compartment lid 301 above the divider 306 will prevent the divider from moving further. By preventing access to the divider securing mechanism from the right unlocked compartment, a thief cannot just simply move the divider 306 and gain access to the delivered goods. Accordingly, the divider securing mechanism 334 can be used to prevent the dividers from being moved and the goods stolen.

Figure 4:
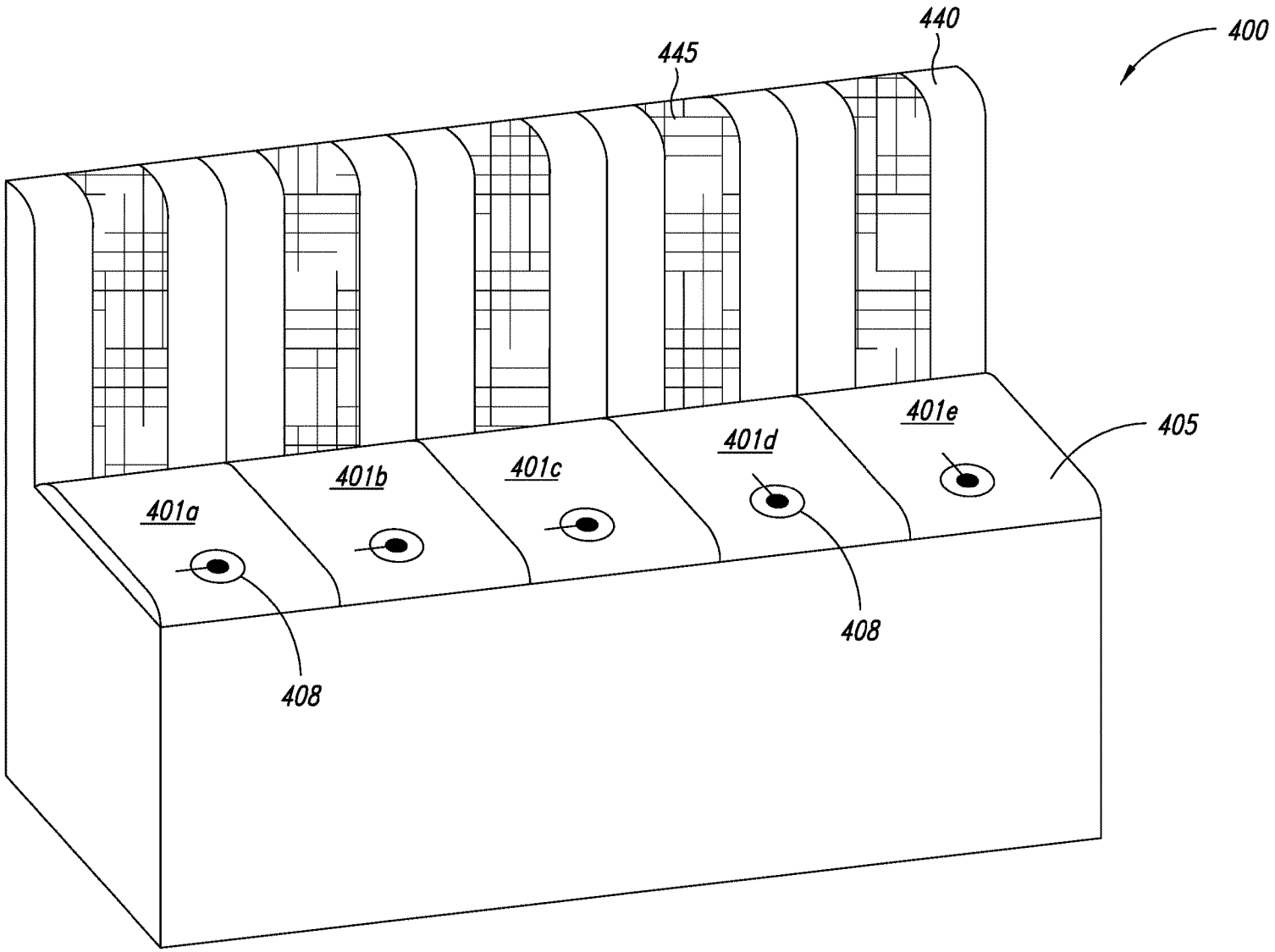
FIG. 4 illustrates a delivery receiving container bench with a backrest according to another embodiment of the present disclosure.

Referring now to FIG. 4, a delivery receiving container 400 with a backrest 440 is shown. The delivery receiving container 400 is similar to the previously described containers 100,200,300. The delivery receiving container 400 comprises compartment lids 401A-401E; hinges (not shown); latches (not shown); cushions 405; dividers (not shown); lift handle (not shown); locking mechanism 408; feet (not shown); and bolts (not shown). Hinges 102,202,302 shown in FIGS. 1A,2A,3A can be used for container 400. Latches 103,203,303 shown in FIGS. 1A,2A,3A can be used for container 400. Dividers 106,206,306 and their respective lift handles 107,207,307 shown in FIGS. 1D,2D,3D can be used for container 400. Dividers 106,206,306 and their respective lift handles 107,207,307 shown in FIGS. 1D,2D,3D can be used for container 400. Feet 109,209,309 and their respective bolts 113,213 shown in FIGS. 1A,1E,2A,3A can be used to mount the container 400 down to a horizontal surface to deter theft. Optionally, bolts 113,213 can be used through hidden holes in the backrest 440 to mount the backrest and the delivery receiving container 400 back against a vertical surface to deter theft.

In FIG. 4, the compartment lids 401A-401E of the container 400 are shown in a closed position, some of which may be locked. Each of the compartment lids 401A-401E includes a cushion 405. Accordingly, in the closed position, compartment lids 401A-401E serve as comfortable seating bench. The container 400 includes a backrest 440 with a back support cushion 445 that increases the utility of the container 400 as a dual function outdoor furniture. The cushions in the compartment lids and the backrest with its cushion can further camouflage the container to be a decorative outdoor bench. Cushions 405 and 445 are preferably made of a weather resistant material appropriate for outdoor use. The container 400 can include a skirt around its base to deter pry bars getting underneath the bottom side of the rectangular box and prying up on the container. The skirt can hide the feet of the container.

In some embodiments of the invention, locking mechanisms 108, 208, 308, 408, etc. can be mounted onto the compartment lids. FIG. 4 illustrates such a placement. In FIG. 4, locking mechanism 408 is shown mounted to the top of compartment lids 401*a*-401*e* on the distal side of the compartment lids 401*a*-401*e* opposite the hinge side. Alternatively, the locking mechanisms 408 can also be mounted to the front wall of the container 400 similar to locking mechanisms 108, 208, and 308 in FIGS. 1A, 2A, 3A respectively.

Upon casual glance at a distance, the container 400 can appear to be a decorative outdoor bench, lessening chances of an opportunistic thief attempting to burgle delivered packages. Due to costs of material and delivery, it can be more effective to disguise a container 400 as an outdoor bench rather than hardening the container 400 against determined intrusion. Furthermore, some dwellings have limited frontage, and being able to serve a dual purpose is of benefit. Thus, in addition to serving as a delivery receiving container, the container 400 can also serve a dual purpose as a decorative outdoor bench.

Figure 5B:
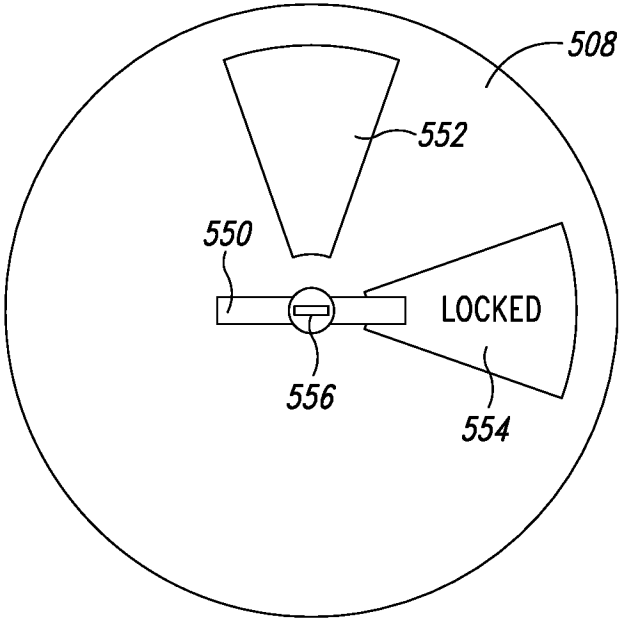
FIG. 5B illustrates a frontal view of a locking mechanism in a locked state according to embodiments of the invention.
Figure 5A:
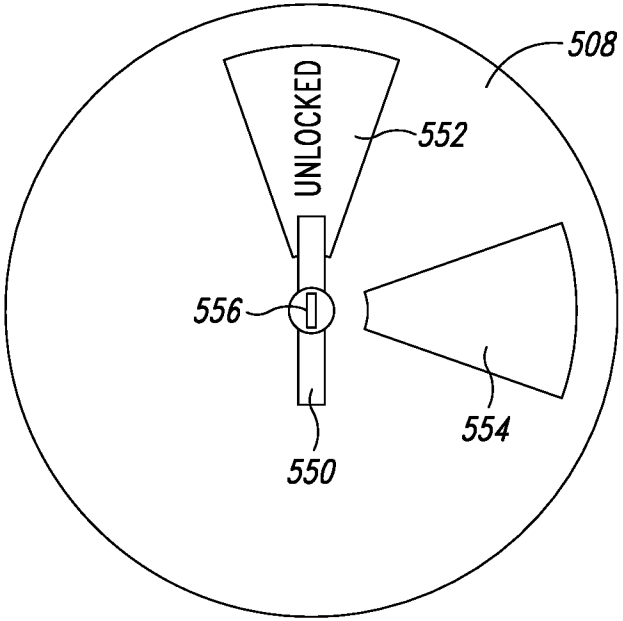
FIG. 5A illustrates a frontal view of a locking mechanism in an unlocked state according to embodiments of the invention.

Referring now to FIGS. 5A-5D, a magnified view of a locking mechanism 508 that can be used as the locking mechanism 108,208,308,408 from some embodiments of the invention of the delivery receiving container 100,200,300, 400. Locking mechanism 508 can have an indicator as to the status of the lock position. In FIG. 5A, a thumbturn 550 allows the locking mechanism 508 to be rotated and switched between a locked position and an unlocked position. Once locked, a key is required to be inserted into a keyhole 556 to turn the thumbturn 550 counterclockwise to the unlocked position. However, no key is needed to turn the thumbturn 550 clockwise to the locked position. Accordingly, a delivery person does not need a key to lock the container 100,200,300,400 after the object or package is placed into the container. The owner of the package/container has a key to unlock the compartment lids from the locked position. Accordingly, each container includes a key for a package owner to use and insert into the keyhole to unlock the compartment lids and gain access to packages in the compartments.

It is desirable to indicate the status of the locking mechanism. A rotating transparent cover can be aligned with the thumbturn 550 to reveal a LOCKED indicator 554 or an UNLOCKED indicator 552 depending upon the position of the thumbturn 550. In FIG. 5A, the thumbturn 550 is illustrated in an unlocked position. A transparent section of a cover plate reveals the visual UNLOCKED indicator 552 but not LOCKED indicator. A quarter turn of the thumbturn 550 rotates the transparent section to uncover the LOCKED indicator 554 but not the UNLOCKED indicator. Other methods of visually indicating the status of the locking mechanism's position is of course within the scope of the invention. The one-way locking mechanism allows couriers of any company to deliver a package and lock a compartment lid without a key. However, the one-way locking mechanism does not allow a compartment lid to be reopened, unless an appropriate key is inserted into the keyhole.

Figure 5D:
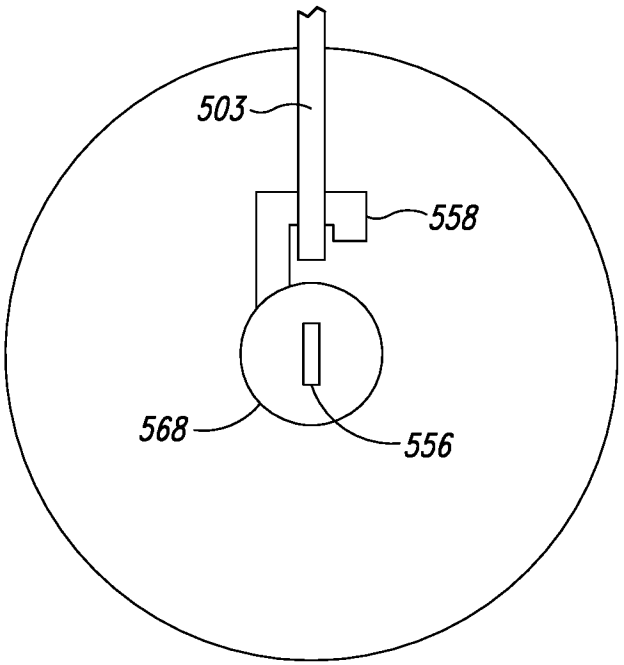
FIG. 5D illustrates a backside view, with cover removed, of a locking mechanism in a locked state according to embodiments of the invention.
Figure 5C:
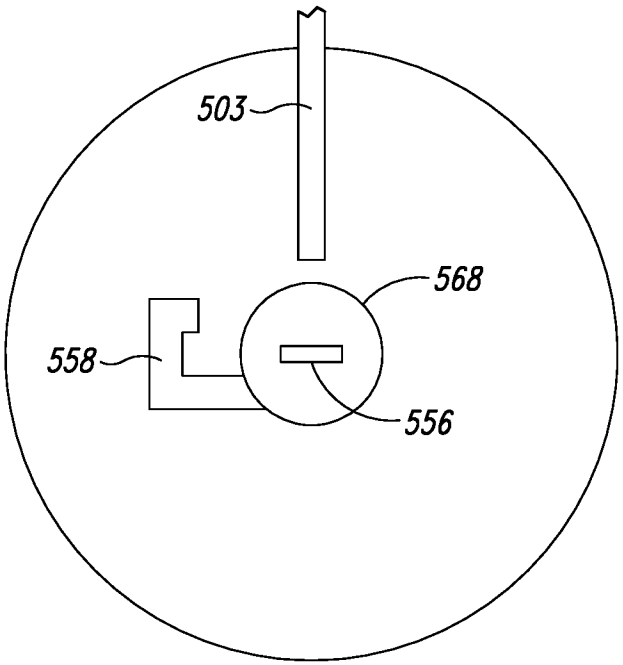
FIG. 5C illustrates a backside view, with cover removed, of a locking mechanism in an unlocked state according to embodiments of the invention.

Referring now to FIGS. 5C-5D, a magnified view of the inside/backside of the locking mechanism 508 is shown with a portion of a latch 503 (an instance of latch 103,203,303). The inside/backside of the locking mechanism 508 is shown without a cover (the cover is removed) to illustrate an exemplary means for locking the compartment lids 101A-101D,201A-201D,301A-301D,401A-401D of the containers 100,200,300,400. Once a compartment lid is closed, the latch 503 coupled to the compartment lid moves into position adjacent the locking mechanism 508, such as shown in FIG. 5C. Latch 503 can be a circular ring or hook shape configured to mate with a rotating hook 558 coupled to the key cylinder 560. The key cylinder 560 can be turned clockwise to the locked position without a key. However, the key cylinder 560 can only be turned counterclockwise to the unlocked position when a key is inserted into the key hole 556. That is, no key is needed to turn cylinder 560 clockwise and couple the rotating hook 558 into the latch 503 in the locked position shown in FIG. 5D.

The locking mechanism illustrated in FIGS. 5A-5D is only for illustrative purposes and is by no means the only method/apparatus for locking the compartment lids of the delivery receiving containers. Other methods and apparatus can be used just as well. For example, a dead bolt type locking mechanism can be used on the side of the container. Similarly, the placement of the locking mechanism on the front side of the container can be changed. The locking mechanism can be placed on the compartment lid and the complimentary latch placed on the inside of the front of the container. For example, a dead bolt type locking mechanism can be used on the compartment lid of the container with a bolt receiver in the side of the container.

However, regardless of the type of locking mechanism used, it is preferable that the lock includes some visual indicators to indicate the lock or unlocked status of the compartment lid. The locking mechanism 508 discloses LOCKED and UNLOCKED visual indicators. Other visual indicators can be used, such a red color signifying a locked status and a green color signifying an unlocked status of the locking mechanism. A visual indicator allows a courier to rapidly determine which compartments are available for storage and which are already in use.

Conclusion

Although certain exemplary embodiments and methods have been described in some detail, for clarity of understanding and by way of example, it will be apparent from the foregoing disclosure to those skilled in the art that variations, modifications, changes, and adaptations of such embodiments and methods can be made without departing from the true spirit and scope of the invention. This disclosure contemplates other embodiments or purposes.

For example, it will be appreciated that one of ordinary skill in the art will be able to employ a number of corresponding alternative and equivalent structural details, such as equivalent ways of fastening, mounting, coupling, or engaging tool components, equivalent mechanisms for producing particular actuation motions, and equivalent mechanisms for delivering electrical energy. As another example, structural details from one embodiment can be combined with or utilized in other disclosed embodiments. Therefore, the above description should not be taken as limiting the scope of the invention which is defined by the appended claims.

What is claimed is:

1. A delivery receiving container comprising:

a rectangular shaped box having an open top and front, back, bottom, left, and right-side walls;

a plurality of compartment lids attached by one or more hinges to the back-side wall of the rectangular shaped box;

a plurality of locking mechanisms opposite the hinges configured to lock the compartment lids in a closed position over the rectangular shaped box, the plurality of locking mechanisms are coupled to the front-side wall of the receiving container opposite the one or more hinges;

a key configured to unlock the plurality of locking mechanisms; and one or more moveable dividers, configured to divide the inside of the rectangular shaped box into separate adjustable compartments that are size adjustable;

one or more pairs of horizontal guide grooves formed in opposing inner side walls of the rectangular shaped box.

2. The delivery receiving container of claim 1, wherein the plurality of locking mechanisms are coupled to the plurality of compartment lids opposite the one or more hinges.

3. The delivery receiving container of claim 1, further comprising one or more bolts secured to the bottom-side wall of the rectangular shaped box, the bolts configured to secure the delivery receiving container to a horizontal surface.

4. The delivery receiving container of claim 1, further comprising, one or more pairs of vertical slots formed in the opposing inner side walls of the rectangular shaped box.

5. The delivery receiving container of claim 4, wherein the one or more dividers further comprise a plurality of tabs on opposing sides of the divider, the plurality of tabs configured to fit into and slide along the one or more pairs of horizontal guide grooves.

6. The delivery receiving container of claim 5, wherein the divider is configured to lock into a horizontally stationary position when the divider is positioned in one pair of the one or more pairs of vertical slots and the divider is lowered into the one pair of vertical slots until the bottom-side wall of the divider contacts a bottom of the delivery receiving container, thereby misaligning the tabs from the one or more pairs of horizontal guide grooves and locking the divider in a horizontally stationary position; and the divider is configured to lock in a vertically stationary position when a compartment lid of the plurality of compartment lids is in a closed and locked position over the divider, thereby preventing the divider from being raised.

7. The delivery receiving container of claim 1, wherein the one or more pairs of horizontal guide grooves including a plurality of slots along their length.

8. The delivery receiving container of claim 7, wherein the one or more dividers further comprise a plurality of tabs on opposing sides of the divider, the plurality of tabs configured to fit into and slide along the one or more pairs of horizontal guide grooves; and a plurality of retractable arms coupled to the divider at the plurality of tabs, the retractable arms configured to extend into slots in the one or more pairs of horizontal guide grooves to lock the divider in a stationary position, and retract from the slots in the one or more pairs of horizontal guide grooves to unlock the divider from the stationary position.

9. The delivery receiving container of claim 1, further comprising a plurality of feet coupled to the bottom-side wall of the rectangular shaped box and configured to raise the rectangular shaped box above a horizontal surface.

10. A delivery receiving container bench comprising:

a hollow rectangular housing with an open top;

a backrest coupled to the housing;

a plurality of compartment lids with cushioned seats coupled thereto;

a plurality of hinges pivotally coupling the plurality of compartment lids coupled to a back side of the hollow rectangular housing;

a plurality of locking mechanisms for each of the plurality of compartment lids opposite the plurality of hinges;

one or more moveable dividers inside the hollow rectangular housing, the one or more moveable dividers configured to divide the interior of the housing into a plurality of adjustable compartments with separate volumes;

one or more pairs of horizontal guide grooves formed in opposing inner side walls of the hollow rectangular housing; and a plurality of feet attached to a bottom side of the hollow rectangular housing.

11. The delivery receiving container bench of claim 10, wherein the plurality of locking mechanisms are coupled to a front side of the hollow rectangular housing opposite the back side to which the plurality of hinges are coupled.

12. The delivery receiving container bench of claim 10, wherein the plurality of locking mechanisms are coupled to the plurality of compartment lids.

13. The delivery receiving container bench of claim 10, further comprising one or more bolts through the plurality of feet, the bolts configured to secure the delivery receiving container bench to a horizontal surface.

14. The delivery receiving container of claim 10, further comprising one or more pairs of vertical slots formed in the opposing inner side walls of the hollow rectangular housing.

15. The delivery receiving container of claim 14, wherein the dividers are configured to lock into a stationary position when the dividers are positioned in the one or more pairs of vertical slots.

16. The delivery receiving container of claim 10, wherein the one or more dividers further comprise a plurality of tabs on opposite sides of the divider, the plurality of tabs configured to fit into and slide along the one or more pairs of horizontal guide grooves.

17. The delivery receiving container of claim 10, wherein the one or more pairs of horizontal guide grooves including a plurality of slots along their length.

18. The delivery receiving container of claim 17, wherein the one or more dividers further comprise a plurality of tabs on opposite sides of the divider, the plurality of tabs configured to fit into and slide along the one or more pairs of horizontal guide grooves; and a plurality of retractable arms coupled to the divider at the plurality of tabs, the retractable arms configured to extend into the plurality of slots in the one or more pairs of horizontal guide grooves to lock the divider in a stationary position, and retract from the plurality of slots in the one or more pairs of horizontal guide grooves to unlock the divider from the stationary position.

19. A method of receiving packages with a delivery receiving container:

unlocking a plurality of compartment lids of a delivery receiving container;

receiving a first package in the delivery receiving container by opening one or more unlocked compartment lids of the delivery receiving container, moving one or more dividers inside of the delivery receiving container to fit the size of the first package, closing one or more compartment lids of the delivery receiving container above the first package appropriate to cover over the first package, locking one or more locking mechanisms to lock the one or more closed compartment lids covering the first package;

receiving a second package in the delivery receiving container by opening one or more unlocked compartment lids of the delivery receiving container, moving one or more dividers inside of the delivery receiving container to fit the size of the second package, closing the one or more compartment lids of the delivery receiving container above the second package appropriate to cover the second package, locking one or more locking mechanisms to lock the one or more closed compartment lids covering the second package;

unlocking the one or more locking mechanism related to the one or more locked compartment lids over the first and second packages, opening the one or more closed unlocked compartment lids over the first and second packages; and retrieving the first and second packages out of the delivery receiving container.

20. The method of claim 19, further comprising prior to the unlocking, securing the delivery receiving container to a horizontal surface with bolts.

21. The method of claim 19, wherein moving the one or more dividers further comprises unlocking the divider from a first stationary position by lifting up the divider at a first pair of vertical slots, until tabs on the divider are aligned with horizontal guide grooves formed in opposing inner sidewalls of the delivery receiving container;

sliding the divider along the guide grooves until the divider is at a second pair of vertical slots; and lowering the divider into the second pair of vertical slots until the bottom of the divider touches the bottom of the container at a second stationary position.

22. The method of claim 19, wherein moving the one or more dividers further comprises unlocking the divider from a first stationary position by retracting retractable arms of the dividers from slots in one or more pairs of horizontal guide grooves formed in the inner side walls of the delivery receiving container;

sliding the divider along the one or more pairs of horizontal guide grooves to a second stationary position; and extending the retractable arms into slots in the one or more pairs of horizontal guide grooves at the second stationary position.

* * * * *